US005505558A

United States Patent [19]

Brown

[11] Patent Number: 5,505,558

[45] Date of Patent: Apr. 9, 1996

[54] UNDERGROUND HORIZONTAL PIPE INSTALLATION METHOD AND APPARATUS

[76] Inventor: David M. Brown, 81 Lowson Cr., Winnipeg, Manitoba, Canada, R3P 0T3

[21] Appl. No.: 320,751

[22] Filed: Oct. 11, 1994

[30] Foreign Application Priority Data

Nov. 9, 1993 [CA] Canada ..... 2102760

[51] Int. Cl.[6] ..... F16L 1/00

[52] U.S. Cl. ..... 405/184; 175/53; 175/62; 405/154

[58] Field of Search ..... 405/184, 154, 405/156, 146, 138; 175/53, 62

[56] References Cited

U.S. PATENT DOCUMENTS

| | | | |
|---|---|---|---|
| 3,874,463 | 4/1975 | Hicks et al. | 175/62 X |
| 4,410,053 | 10/1983 | Masse | 175/53 |
| 4,874,268 | 10/1989 | Akesaka | 405/184 |

*Primary Examiner*—Dennis L. Taylor

[57] ABSTRACT

Piping is laid horizontally underground, by horizontally entering a rod that is longer than the site, into the site, at the desired depth of the center of the piping tunnel, and then horizontally pushing that rod through the site, until its front end exits the back of the site. Then attaching three rods near the front end of the first rod, and bringing all four rods back through the site, until the first rod exits the front of the site, and the other three rods are embedded in their own paths in the site, with their front ends extending into the front of the site, and their back ends extending into the back of the site. Then, at the back of the site, attaching a push-pull type earth coring knife to the middle of the three rods, and connecting a front cutting and shielding means, between the two outer rods, so that it is situated immediately behind the front cutting portion of the coring knife. Then, placing a piece of the piping inside the back of the front cutting and shielding means so that it abuts the front cutting and shielding means and cannot be moved forward without it also moving the front cutting and shielding means forward. Then, placing a pulling and holding means over the back of the piece of pipe, so that it abuts the back of the piece of pipe, and cannot be moved forward without also moving the piece of pipe forward with it. Then attaching the pulling and holding means, between the two outer rods, near their ends. Then, by pulling the rods back through the site, pulling the coring knife, the pulling and holding means, the piece of pipe, and the front cutting and shielding means, into and through the site.

9 Claims, 3 Drawing Sheets

UNDERGROUND HORIZONTAL PIPE INSTALLATION METHOD AND APPARATUS

BACKGROUND OF THE INVENTION

1. Field of the Invention

This invention relates to a new method and apparatus for installing sections of underground piping, and more specifically, to a new method and apparatus for installing sections of piping, horizontally underground, without 10 excavation, and without pre-drilling the tunnel in which the piping is to be installed.

2. Description of Related Art

Laying underground piping, whether it is laid horizontally or vertically, has been accomplished for many decades, in a variety of ways. The most obvious method, for laying piping underground, is to first excavate the site in which the piping is to be laid, then laying the piping, and then filling in that portion of the excavation that is not occupied by the piping. When piping is being laid vertically, there is only a small amount of wasted effort and expense, by first excavating, and then laying the piping. There is also only a small amount of unnecessary surface area destruction. The reason, is that if the piping is laid vertically, to open at the surface, as for example in an oil well, it is the intention, that the initial digging, that opens the surface, to the descended depth of the hole, is to remain as an opening, from the surface to said depth. The piping is then usually inserted, to keep the walls of the vertical hole from collapsing. It is rarely, if ever, the intention, when laying vertical piping, to lay the piping, and then permanently seal the surface opening.

However, when piping is to be said horizontally, to run substantially parallel with the surface, at a certain depth beneath the surface, then the excavation, must of necessity, dig up much more of the ground than will remain open, and the destruction of the surface is the destruction of something that must be restored after the piping is laid. Therefore, the first obvious disadvantage, to excavating the site of the laying of horizontal piping, is that a large amount of effort and expense is expended, to dig a large hole, that must be filled in again, as soon as the piping is in place. The second obvious disadvantage, is that if the site under which the piping must be placed, is man-finished, such as by a paved surface, then the expensive paved surface, that is initially torn up and destroyed, to allow the site to be excavated, must be replaced after the piping has been laid, and the excavation filled in. An expensive paved surface has therefore been lost, and another one has to be paid for to take its place, after the piping was laid.

Devices have been invented, to dig horizontally underground, between two pits, that flank the surface area, that is to be horizontally tunneled under. Some of those devices operate rotationally, and others operate by being pushed or pulled through the earth. Some of those devices can be used over long distances, others can only be used between site flanking pits that are relatively close together. However, after any of the digging devices have been used, whether they are rotational horizontal drilling devices, or push-pull horizontal drilling device, it is then necessary to install the piping. The pipe installation operations, using the known devices, are therefore two stage operations. The first stage involves digging the horizontal tunnel, and the second stage involves inserting the piping into the horizontal tunnel. An obvious problem of continuous concern, is that there is always the possibility that the tunnel will collapse before the piping has been inserted, or during the piping insertion stage, or that the insertion of the piping will cause parts of the horizontal tunnel to collapse.

An object of the present invention, is to provide a method and apparatus, for installing horizontally running underground piping, without first having to excavate the site under which the piping is to be installed.

A second object of the present invention, is to provide a method and apparatus, for installing horizontally running underground piping, that will substantially reduce, or eliminate, the possibility of the piping tunnel collapsing, before the piping has been installed.

A third object of the present invention, is to provide a method and apparatus, for installing horizontally running underground piping, as part of the tunnel digging process itself.

A fourth object of the present invention, is to provide a method and apparatus, for installing horizontally running underground piping, that digs the piping tunnel, and installs the piping, in the same stage.

SUMMARY OF THE INVENTION

The method of the present invention, for installing horizontally running underground piping, is comprised of, taking a pilot rod that is longer than the length of the piping to be laid, and from an open depression at the front of the site, horizontally entering the pilot rod into the site, at the desired depth of the center of the piping tunnel, and then horizontally pushing the pilot rod through the site, at that depth, until it exits the site, into an open depression at the back of the site. Then, attaching two fixedly spaced steering rods near the front of the pilot rod, and attaching one coring rod near the front of the pilot rod, so that it is fixedly spaced centrally between the two steering rods, with its central axis lying in the plane defined by the central axes of the two steering rods, Then, by pulling the pilot rod, causing the pilot rod, with its three fixedly spaced rods attached near its front, to move back along its initial path through the site, so that the three fixedly spaced rods travel through the site in their own paths, until the pilot rod exits the site, into the open depression at the front of the site, leaving the three rods, that were attached near its front, embedded in their own paths in the site, with their front ends extending into the depression at the front of the site, and with their back ends extending into the depression at the back of the site. Then, in the depression at the back of the site, attaching a push-pull type earth coring knife, near the back end of the coring rod; wherein the coring knife is suitable to cut a tunnel through the site of a slightly smaller diameter than the diameter of the piping to be laid, and of the same cross-sectional shape as the cross-sectional shape of the piping to be laid. Then, in the depression at the back of the site, connecting a front cutting and shielding means, between the two steering rods, so that their back ends extend beyond the front cutting and shielding means, and so that the front cutting and shielding means is situated immediately behind the front cutting portion of the coring knife; which front cutting and shielding means is of the same cross-sectional shape as the cross sectional shape of the piping to be laid, and at its front edge, is of a marginally larger internal diameter than the external diameter of the piping to be laid, and inside its front edge, is of a diameter that is smaller than the external diameter of the piping to be said but larger than the external diameter of the coring knife, and it is of sufficient strength to cut through the ground, if it is pushed or pulled through the ground with sufficient force. Then, placing a piece of the piping to be laid, inside the back of the front cutting and shielding means, so that it abuts the smaller internal diameter portion of the front cutting and shielding means, and cannot be moved forward, without also moving the front cutting and shielding means forward. Then, placing a pulling and holding means, having the same cross sectional shape as the piping to be laid, and having an internal diameter from its front edge to near its back edge that is marginally larger than the external diameter of the piping to be laid, and having an internal diameter near its back edge that is smaller than the external diameter of the piping to be laid, over the back of the piece of pipe, so that its smaller internal diameter near its back edge abuts the back of the piece of pipe, and the pulling and holding means cannot be moved forward, without also moving the piece of pipe forward with it. Then attaching the pulling and holding means between the two steering rods, near their ends. Then, by pulling the coring rod through the site, pulling the coring knife from the open depression at the back of the site, into and partly through the site, and pulling the two steering rods partly back through the site, thereby forcing the pulling and holding means, and the piece of pipe, and the front cutting and shielding means, to be pulled partly through the site, behind the coring knife. Then continuing to pull the coring knife and the steering rods through the site, until the piece of pipe is entirely in the site. Then removing the pulling and holding means from the back of the piece of pipe, placing another piece of pipe immediately behind the inserted piece of pipe, so that it abuts up against its back end, and placing the pulling and holding means over the back of the second piece of pipe. Then again attaching the pulling and holding means, between the two steering rods, proximate their ends. Then pulling the coring knife further into the site, and pulling the two steering rods back through the site, thereby forcing the pulling and holding means, and the two pieces of pipe, and the front cutting and shielding means, further into and through the site, until the second piece of pipe is entirely in the site. Then again removing the pulling and holding means, adding another piece of pipe be, hind the second piece of pipe, again attaching the pulling and holding means behind the last piece of pipe, and to the steering rods, and again pulling the coring knife and steering rods further into the site. Removing earth from the back of the coring knife as necessary, either by pushing the coring knife back toward the back of the site, or by digging it out. Repeating the process of removing the pulling and holding means, and adding new sections of piping, and then pulling them into the site, as the coring knife and the two steering rods are pulled further into the site, until the front cutting and shielding means emerges into the open depression at the front of the site, and the piping has thereby been laid in the site. Then disconnecting the pulling and holding means from the steering rods, removing it from the back of the last piece of piping, pulling the steering rods out of the site, and removing the front cutting and shielding means and coring knife.

The tunneling and pipe laying has been done in one stage. The chance of the tunnel collapsing has been greatly reduced or eliminated. The surface did not have to be excavated, and therefore did not have to be re-surfaced, or filled in, after the piping was laid.

The apparatus of the present invention, for installing horizontally running underground piping, is comprised of, one pilot rod, one coring rod, and two steering rods, all which are each longer than the length of the piping to be laid, and of sufficient strength to be pushed through the site into which the piping is to be laid, without breaking or bending. It is also comprised of, a rod assembly divider, that is comprised of three cylinders that are rigidly connected to each other, such that a first of the cylinders is at one end, a second of the cylinders is in the center, and the third of the cylinders is at the other end, and such that all of the central axes of all three cylinders lies in the same plane. It is also comprised of a push-pull type earth coring knife, that is suitable to cut a tunnel through the site that is of a slightly smaller diameter than the diameter of the piping to be laid, and of the same cross-sectional shape, as the cross-sectional shape of the piping to be laid. It is also comprised of a front cutting shield that is of the same cross sectional shape as the cross sectional shape of the piping to be laid, and at its front edge, is of a marginally larger internal diameter than the external diameter of the piping to be laid, and inside its front edge, is of a diameter that is smaller than the external diameter of the piping to be laid but larger than the external diameter of the coring knife, and at diametrically opposed portions of its exterior has guiding means, by means of which it can be connected with the steering rods, and which front cutting shield is of sufficient strength to cut through the ground, if it is pushed or pulled through the ground with sufficient force. It is also comprised of a pulling cap, that is of the same cross sectional shape as the piping to be laid, and from its front edge to near its back edge is of a marginally larger internal diameter than the external diameter of the piping to be laid, and near its back edge is of an internal diameter that is smaller than the external diameter of the piping to be laid but larger than the external diameter of the coring knife, and has holding means at diametrically opposed ends of its exterior, to which the steering rods can be fixedly attached. From an open depression at the front of the site, the pilot rod is horizontally pushed through the site at the desired depth of the center of the piping tunnel, until its front end exits into an open depression at the back of the site. The rod assembly divider is then attached to the pilot rod's exposed end at the back of the site. The coring rod and the two steering rods are attached to the rod assembly divider. All four rods are then pulled through the site, until the pilot rod exits into the open depression at the front of the site, and the other three rods are embedded in their own paths in the site, with their front ends extending into the open depression at the front,of the site, and their back ends extending into the open depression at the back of the site. The earth coring knife is then attached to the end of the coring rod that is in the open depression at the back of the site, the front cutting shield is connected with the two steering rods, by its guiding means, so that it is between them, and so that their back ends extend beyond the front cutting shield, and so that the front cutting shield is situated immediately behind the front cutting portion of the coring knife. A piece of the piping to be laid is then placed inside the back of the front cutting shield, so that it abuts the narrower interior diameter of the front cutting shield, and cannot be moved forward without it also moving the front cutting shield forward. The pulling cap is then placed over the back of the piece of pipe, so that its narrower interior diameter abuts the back of the piece of pipe, and it cannot be moved forward without it also moving the piece of pipe forward with it. The pulling cap is then attached to the ends of the two steering rods by its holding means. Then, by beginning to pull the coring rod and the two steering rods through the site, the coring knife and the front cutting shield and the piece of piping and the pulling cap, are begun to be pulled into and through the site. Then continuing to pull the coring knife and the steering rods through the site, until the piece of pipe is entirely in the site. Then removing the pulling cap from the back of the piece of pipe, placing another piece of pipe immediately behind the inserted piece of pipe, so that it abuts up against its back end, and placing the pulling cap over the back of the second piece of pipe. Then again attaching the pulling cap to the ends of the two steering rods. Then pulling the coring knife and the front cutting shield and the pieces of piping and the pulling cap further into the site, until the second piece of pipe is entirely in the site. Then again removing the pulling cap, adding another piece of pipe behind the second piece of pipe, again attaching the pulling cap behind the last piece of pipe, and to the steering rods, and again pulling the coring knife and the front cutting shield and the pieces of piping and the pulling cap further into the site. Removing earth from the back of the coring knife as necessary, either by pushing the coring knife back toward the back of the site, or by digging it out. Repeating the process of removing the pulling cap and adding new sections of piping, and then pulling them into the site, by means of the coring rod and the two steering rods, until the front cutting shield emerges into the open depression at the front of the site, and the piping has thereby been laid in the site. Then removing the coring rods and steering rods, and removing the front cutting shield and the pulling cap.

DESCRIPTION OF THE PREFERRED EMBODIMENT

Figure 1:
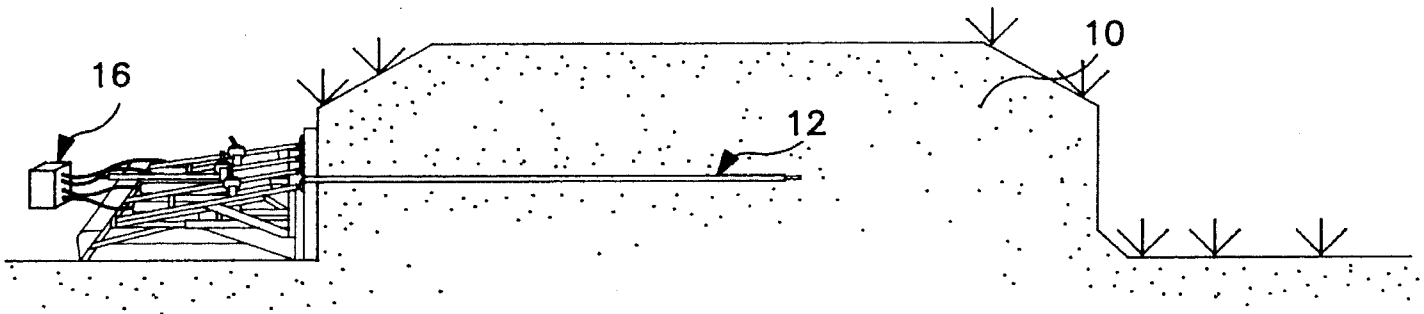
FIG. 1 is a diagram of the entry of the pilot rod, into the site, in which the piping is to be laid.

The preferred method of the present invention, for installing horizontally running underground piping, is illustrated in FIGS. 1 and 2, and 5 and 6. It is comprised of taking a pilot rod that is longer than the length of the piping to be laid, and from an open depression at the front of the site, horizontally entering the pilot rod into the site, at the desired depth of the center of the piping tunnel, and then horizontally pushing the pilot rod through the site, at that depth, until it exits the site, into an open depression at the back of the site. Then attaching two fixedly spaced steering rods near the front of the pilot rod, and centrally attaching one coring rod near the front of the pilot rod, so that it is fixedly spaced, centered between the two steering rods, such that its central axis lies in the plane defined by the central axes of the two steering rods. Then pulling the pilot rod, with the three fixedly spaced rods attached near its front, back along its initial path through the site, so that it pulls them through their own paths in the site, until the pilot rod exits the site, into the open depression at the front of the site, leaving the three rods, that were attached near its front, embedded In their own paths in the site, with their front ends extending into the depression at the front of the site, and with their back ends extending into the depression at the back of the site. Then, in the depression at the back of the site, attaching a push-pull type earth coring knife, near the back end of the coring rod; wherein the coring knife is suitable to cut a tunnel through the site of a slightly smaller diameter than the diameter of the piping to be laid, and of the same cross-sectional shape, as the cross-sectional shape of the piping to be laid. Then, in the depression at the back of the site, connecting a front cutting and shielding means, between the two steering rods, so that their back ends extend beyond the front cutting and shielding means, and so that the front cutting and shielding means is situated immediately behind the front cutting portion of the coring knife; which front cutting and shielding means, is of the same cross sectional shape as the cross sectional shape of the piping to be laid, and at its front edge, is of a marginally larger internal diameter than the external diameter of the piping to be laid, and inside of its front edge, is of a diameter that is smaller than the external diameter of the piping to be laid, but larger than the external diameter of the coring knife, and it is of sufficient strength to cut through the ground, if it is pushed or pulled through the ground with sufficient force. Then, placing a piece of the piping to be laid, inside the back of the front cutting and shielding means, so that it abuts the smaller interior diameter portion of the front cutting and shielding means, and cannot be moved forward, without it also moving the front cutting and shielding means forward. Then, placing a pulling and holding means, that has the same cross sectional shape as the piping to be laid, and from its front edge to near its back edge is of a marginally larger internal diameter than the external diameter of the piping to be laid, and from its back edge to near its back edge is of a smaller diameter than the external diameter of the piping to be laid, but of a larger diameter than the external diameter of the coring knife, over the back of the piece of pipe, so that its smaller internal diameter near its back edge abuts the back of the piece of pipe, and the pulling and holding means cannot be moved forward, without It also moving the piece of pipe forward. Then, attaching the pulling and holding means between the two steering rods, near their ends. Then beginning to pull the coring rod, with coring knife attached, through the site, and beginning to pull the two steering rods, which are attached to the pulling and holding means, through the site, which pull the pulling and holding means, piece of piping, and front cutting and shielding means into and partly through the site. Continuing to pull the coring knife, and the steering rods, through the site, until the piece of pipe is entirely in the site. Then, removing the pulling and holding means from the back of the piece of pipe, and placing another piece of pipe immediately behind the inserted piece of pipe, so that it abuts up against its back end, and then placing the pulling and holding means over the back of the second piece of pipe, and again attaching the pulling and holding means, between the two steering rods, proximate their ends, and again pulling the coring knife further into the site, and pulling the two steering rods further back through the site, thereby forcing the pulling and holding means, and the two pieces of pipe, and the front cutting and shielding means, further into the site, until the second piece of pipe is entirely in the site. Then, again removing the pulling and holding means, adding another piece of pipe behind the second piece of pipe, again attaching the pulling and holding means behind the last piece of pipe, and to the steering rods, and again pulling the coring knife and steering rods further into the site. Removing earth from the back of the coring knife as necessary, by pushing the coring knife back toward the back of the site. Repeating the process of removing the pulling and holding means, and adding new sections of piping, and then pulling them into the site, by pulling the coring knife and the two steering rods further into the site, until the front cutting and shielding means emerges into the open depression at the front of the site, and the piping has thereby been laid in the site. Then disconnecting the pulling and holding means from the steering rods, removing it from the back of the last piece of piping, pulling the steering rods out of the site, and removing the front cutting and shielding means and coring knife. The pipe has now been laid, all of the equipment has been removed, and the site is completed. No refilling of an excavation is required, and no resurfacting is required.

A preferred embodiment of an apparatus of the present invention, is comprised of, one pilot rod 12, one coring rod 14, and two steering rods 13 and 15. Each of rods 12 to 15 are longer than the length of the piping to be laid, and of sufficient strength to be pushed through the site into which the piping is to be laid, without breaking or bending. In the preferred embodiment all of the rods 12 to 15 are identical. They are each made of metal, and they each taper to a threaded (not illustrated) rounded point, at their ends. The apparatus of the preferred embodiment is also comprised of a rod assembly divider 11. In the preferred embodiment, the rod assembly divider 11 is made of metal, and is wing shaped, being made up of a first central cylinder 24, a second outer cylinder 25, that is rigidly fixed a predetermined distance from the central cylinder, and a third outer cylinder 26, that is rigidly fixed the same distance from the central cylinder as was cylinder 25, but on the opposite side of the central cylinder 24. The outer cylinders 25 and 26 are fixed to the central cylinder by being welded to spacing members 27, which are welded to the central cylinder. In the preferred embodiment, all of the central axes of all three cylinders 24, 25 and 26, lie in the same plane. The preferred embodiment is also comprised of a metal push-pull type earth coring knife 18, that is suitable to cut a tunnel through the site, of a slightly smaller diameter, than the diameter of the piping to be laid, and of the same cross-sectional shape as the cross-sectional shape of the piping to be laid. The preferred embodiment is also comprised of a metal front cutting shield 17, that Is of the same cross sectional shape, as the cross sectional shape of the piping to be laid, and from its back edge to near its front edge, is of a marginally larger internal diameter than the external diameter of the piping to be laid. At its front edge it is also of a marginally larger internal diameter than the external diameter of the piping to be laid. The front cutting shield 17 has lip 28 that tapers inwardly a small distance from its front edge 30, thereby facilitating its cutting through the ground of the site. The diameter of the lip 28, at its narrowest, is smaller than the external diameter of the piping to be laid and larger than the external diameter of the coring knife. At diametrically opposed portions of the exterior of the front cutting shield are metal cylinders 23 that are welded to the front cutting shield. Their interior diameter is large enough to allow either one of the steering rods 13 and 15 to freely pass through them. The front cutting shield is of sufficient strength to cut through the ground, If it is pushed or pulled through the ground with sufficient force. The preferred embodiment is also comprised of a metal pulling cap 20, that is of the same cross sectional shape as the piping to be laid, and has an internal diameter, from near its back end, up to its front end, that is marginally greater than the external diameter of the piping to be laid, and an internal diameter at its back end that is smaller than the external diameter of the piping to be laid and larger than the external diameter of the coring knife. The pulling cap 20, also has, at diametrically opposed portions of its exterior, metal cylinders 21, that are welded to the pulling cap. Their interior diameter is large enough to allow the steering rods 13 and 15 to freely pass through them. The final components of the preferred embodiment are the two threaded couplings 22, which have a larger diameter than the exterior diameter of cylinders 21, and which may be threaded onto the threaded ends of the steering rods, and a threaded coupling cylinder (not illustrated) which has a larger diameter than the exterior diameter of each of cylinders 24 to 26, and which can be threaded onto any of the threaded ends of any of rods 12 to 15.

Figure 2:
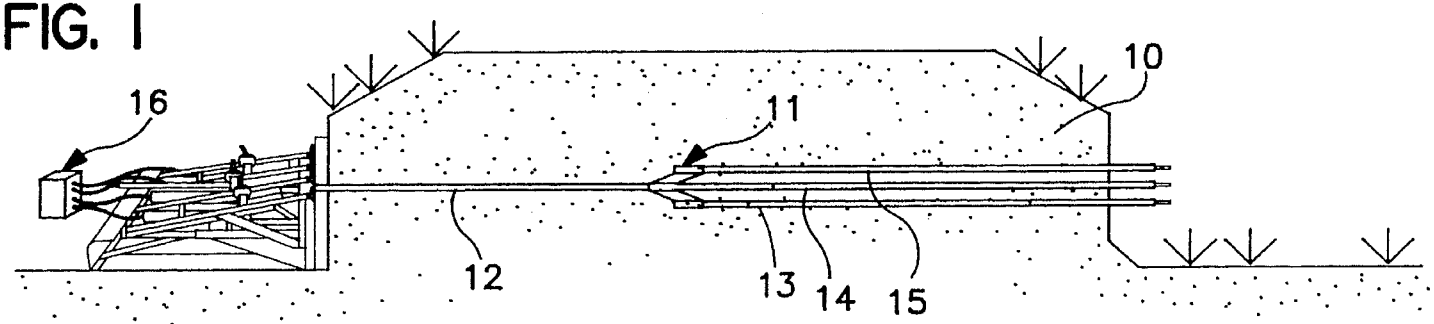
FIG. 2 is a diagram of the pulling back by the pilot rod, of the rod assembly divider, with the coring rod and two steering rods secured within it.
Figure 3:
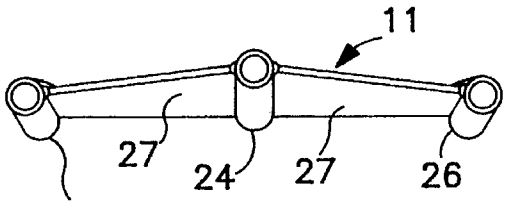
FIG. 3 is a perspective view of a rod assembly divider.
Figure 4:
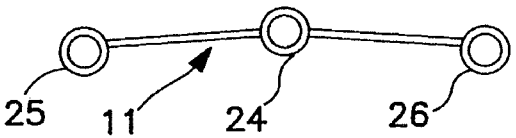
FIG. 4 is a front view of a rod assembly divider.
Figure 5:
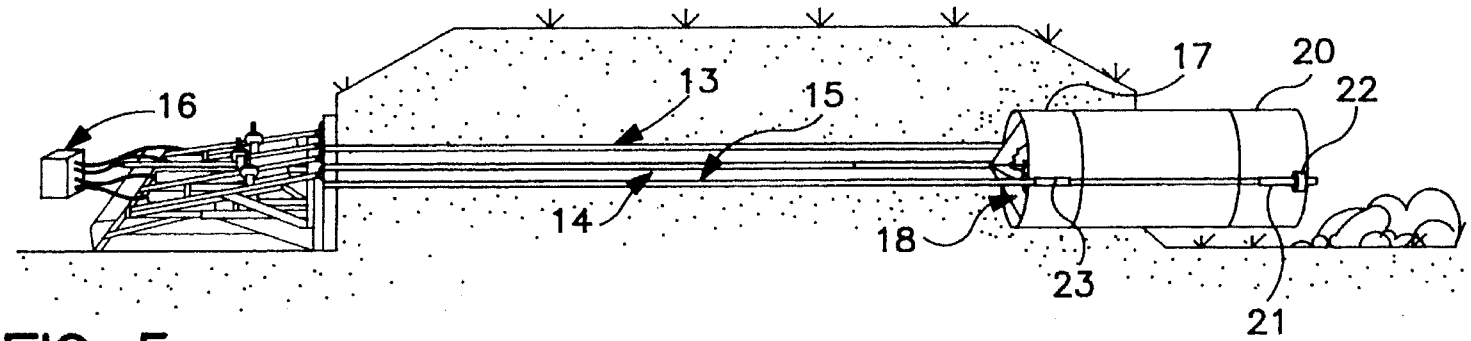
FIG. 5 is a diagram of the entry of the coring knife, front cutting shield, first section of piping, and the pulling cap, into the site, in which the piping is to be laid.
Figure 6:
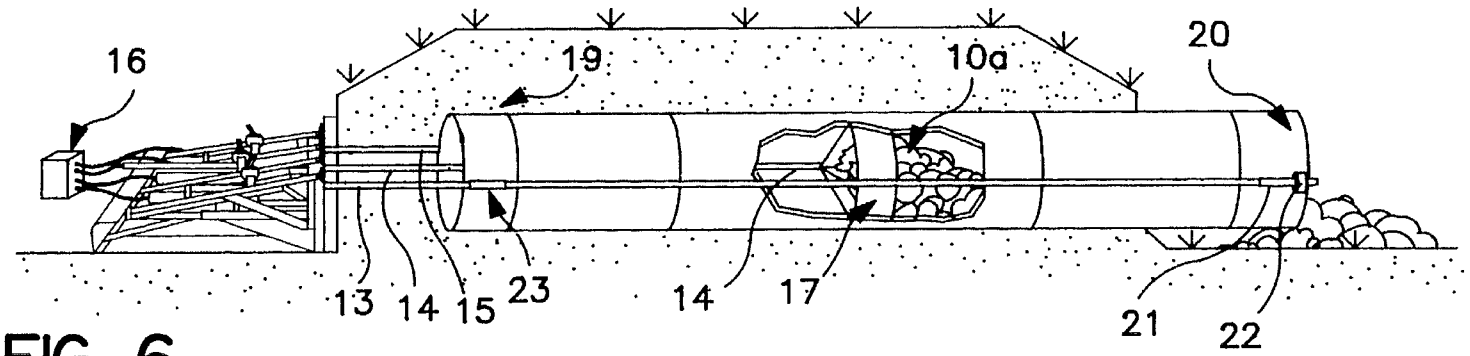
FIG. 6 is a diagram of the laying of the final section of piping.
Figure 7:
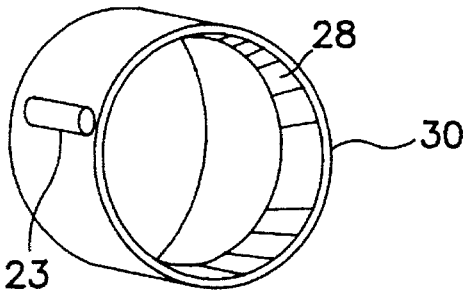
FIG. 7 is a perspective view of a cutting shield.
Figure 8:
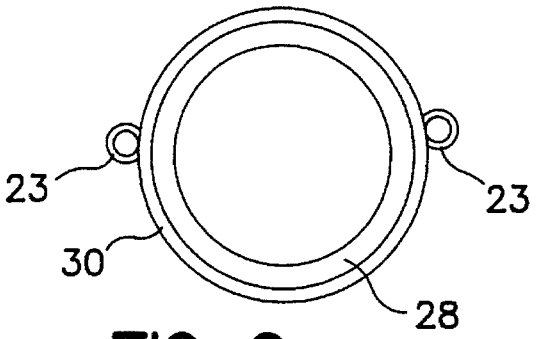
FIG. 8 is a front view of a cutting shield.
Figure 9:
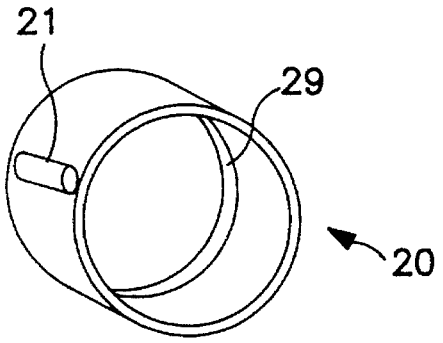
FIG. 9 is a perspective view of a pulling cap.
Figure 10:
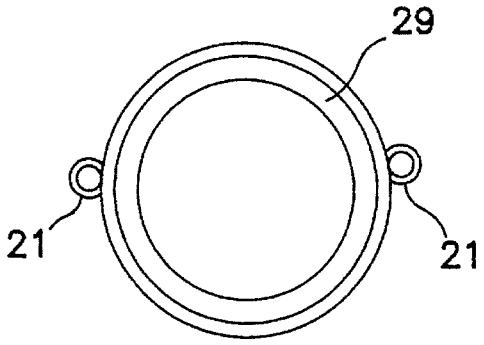
FIG. 10 is a front view of a pulling cap.

As illustrated in FIG. 1, from an open depression at the front of the site, the pilot rod 12 is horizontally pushed through the site at the desired depth of the center of the piping tunnel, It is continued to be pushed through the site until its front end exits into ah open depression at the back of the site. The rod assembly divider 11 is then slid over the pilot rod's exposed end at the back of the site, and fastened to it, by threading the coupling cylinder part way onto its end. The coring rod 14 is then threaded into the remaining open portion of the coupling cylinder. Each of steering rods 13 and 15 is slid through one of the cylinders 25 and 26 of the rod assembly divider, so that its end extends beyond the cylinder it was slid into, and it is fastened within that cylinder by having one of couplings 22 threaded onto its extended end. As illustrated in FIG. 2 all four rods are then pulled back through the site, until the pilot rod exits into the open depression at the front of the site, and the other three rods are embedded in their own paths in the site, with their front ends extending into the open depression at the front of the site, and their back ends extending into the open depression at the back of the site. The earth coring knife 18 is then rigidly connected with the end of the coring rod 14 that is in the open depression at the back of the site, the front cutting shield 17 is then situated immediately behind the front cutting portion of the coring knife 18, with each of steering rods 13 and 15 slid through one of the metal cylinders 23 of the front cutting shield, so that its end extends beyond the end of the cylinder 23 through which it was slid. As shown in FIG. 5, a piece of the piping to be laid is then placed inside the back of the front cutting shield 17, so that it abuts the narrower interior diameter of the front cutting shield, and cannot be moved forward without it also moving the front cutting shield forward. The pulling cap 20 is then placed over the back of the piece of pipe, so that its narrower interior diameter 29 abuts the back of the piece of pipe, and it cannot be moved forward without it also moving the piece of pipe forward with it. Each of the two steering rods 13 and 15 then has its end slid through one of the cylinders 21 on the pulling cap, and locked in place by having one of the threaded couplings 22 threaded onto it. Then, by pulling the coring rod 14 and the two steering rods 13 and 15 through the site, the coring knife and the front cutting shield and the piece of piping and the pulling cap, are pulled into the site. Then continuing to pull the coring knife and the steering rods through the site, until the piece of pipe is entirely in the site. Then removing the pulling cap from the back of the piece of pipe, placing another piece of pipe immediately behind the inserted piece of pipe, so that it abuts up against its back end,.and placing the pulling cap over the back of the second piece of pipe. Then again attaching the pulling cap to the ends of the two steering rods by means of the couplings 22. Then pulling the coring knife and the front cutting shield and the pieces of piping and the pulling cap further into the site, until the second piece of pipe is entirely in the site. Then again removing the pulling cap, adding another piece, of pipe behind the second piece of pipe, again attaching the pulling cap behind the last piece of pipe, and to the steering rods, and again pulling the coring knife and the front cutting shield and the pieces of piping and the pulling cap further into the site. Removing earth from the back of the coring knife as necessary, as illustrated in FIG. 6, by pushing the coring knife back toward the back of the site. Repeating the process of removing the pulling cap and adding new sections of piping, and then pulling them into the site, by means of the coring rod and the two steering rods, until the front cutting shield emerges into the open depression at the front of the site, and the piping has thereby been laid in the site. Then removing the coring rod and steering rods, and removing the front cutting shield and the pulling cap.

By using an apparatus as described in the preferred embodiment, the tunneling and pipe laying is done in one stage. There is never a time when an unsupported tunnel exists in the site. Therefore, the chance of the tunnel collapsing has been reduced to being almost an impossibility. The surface of the site does not have to be excavated, and therefore, if the site is under a paved road, the pavement does not have to be torn up. Consequently, the site does not have to be filled in after the piping has been laid, and the surface does not have to be re-surfaced, as it was not disturbed by the laying of the piping.

The steering rods 13 and 15 serve four purposes, firstly, to keep the front cutting shield concentric with the coring knife; secondly, to hold the pulling cap onto the back of the piping that is being laid; thirdly, to pull the pulling cap, and therefore the piping between the pulling cap and the front cutting shield, and the front cutting shield, through the site; and fourthly, to allow the piping to be steered within the site, as it is being laid. If due to different earth densities, or hardnesses, within the site, or for some other reason, the piping begins to veer off of its desired path, then, by pulling with greater force on the left or right steering rod, the front cutting shield, piping, and pulling cap, can be steered to correct for the veer.

While the coring knife is being pulled through the site, cored earth will build up behind it. However, because the coring knife is pulled by its own rod 14, independently of the steering rods 13 and 15, that are pulling the pulling cap, it can be moved either forward, or backward, through the site, without affecting the direction or the movement of the pulling cap, which is solely controlled by the steering rods. Therefore, the coring knife can be moved backwards in the piping, without the piping having to be moved backwards. By moving the coring knife backwards in the piping, the cored earth behind the coring knife is forced out the back of the piping, and into the open depression at the back of the site, thereby clearing the piping tunnel of cored earth.

Some variations in the method and apparatus as described above can be seen to be within the scope of the invention, and will be obvious to those skilled in the art, and are included within the scope of the claims.

I claim:

1. A method of laying piping horizontally underground in a piping site that is situated between an open depression at the front of the site and an open depression at the back of the site, comprised of:

(a) from an open depression at the front of the site, horizontally entering a first rod into the site, at the desired depth of the center of the desired piping tunnel, which first rod is longer than the desired length of the tunnel;

(b) pushing the first rod horizontally through the site, until it's back end exits the site, into an open depression at the back of the site;

(c) attaching a second rod, a third rod, and a fourth rod, proximate the back end of the first rod, such that they are fixedly spaced apart, wherein each of the second, third, and fourth rods, are longer than the intended piping tunnel, and wherein the central axes of the second, third, and fourth rods, lie in the same plane, and the third rod is located centrally between the second and fourth rods;

(d) causing the first rod, with the second, third, and fourth rods attached to it, to be moved back through the site, along its initial path into the site, until the front ends of the second, third, and fourth rods, exit the site, into the open depression at the front of the site, leaving the second, third, and fourth rods, embedded in their own paths in the site, with their front ends, extending into the depression at the front of the site, and with their back ends, extending into the depression at the back of the site;

(e) In the depression at the back of the site, attaching a push-pull type earth coring knife, near the back end of the third rod, wherein the coring knife, is suitable to cut a tunnel through the site, of a slightly smaller diameter, than the diameter of the piping to be laid,, and of the same cross-sectional shape, as the cross-sectional shape of the piping to be laid;

(f) in the depression at the back of-the site, connecting a front cutting and shielding means, between the second and fourth rods, proximate their back ends, and so that their back ends extend beyond the front cutting and shielding means, and so that the front cutting and shielding means is situated immediately behind the front cutting portion of the coring knife, which front cutting and,shielding means, is of the same cross sectional shape, as the cross sectional shape of the piping to be laid, and at its front edge, is of a larger internal diameter than the external diameter of the piping to be laid, and internal of its front edge, is of a smaller diameter than the external diameter of the piping to be laid, but of a larger diameter than the external diameter of the coring knife, and it is and of sufficient strength to cut through the site, if it is pushed or pulled through the site with sufficient force;

(g) placing a piece of the piping to be laid, inside the back of the front cutting and shielding means;

(h) placing a pulling and holding means, having the same cross sectional shape as the piping to be laid, and having an internal diameter, from its front edge, to near its back edge, that is larger than the external diameter of the piping to be laid, and having an internal diameter near its back edge, that is smaller than the external diameter of the piping to be laid, over the back of the piece of pipe, so that its smaller internal diameter near its back edge abuts the back of the piece of pipe, and therefore the pulling and holding means cannot be moved forward, without also moving the piece of pipe forward with it;

(i) fixedly attaching the pulling and holding means, between the second and fourth rods, near their ends;

(j) pulling the third rod partly through the site, thereby partly pulling the coring knife, from the open depression at the back of the site, into and through the site, and partly pulling the second and fourth rods back through the site, thereby forcing the pulling and holding means, and the piece of pipe, and the front cutting and shielding means, to also be pulled partly through the site, behind the coring knife;

(k) continuing to pull the second, third, and fourth rods back into and through the site, until the piece of pipe is entirely in the site, then removing the pulling and holding means from the back of the piece of pipe, placing another piece of pipe immediately behind the inserted piece of pipe, so that it abuts up against its back end, and placing the pulling and holding means over the back of the second piece of pipe, then, again fixedly attaching the pulling and holding means, between the second and fourth rods, near their ends, and again pulling the second, third, and fourth rods further into and through the site, thereby forcing the pulling and holding means, and the two pieces of pipe, and the front cutting and shielding means, also into and through the site, until the second piece of pipe is entirely in the site, then again removing the pulling and holding means, adding another piece of pipe behind the second piece of pipe, again attaching the pulling and holding means behind the latest piece of pipe, and to the second and fourth rods, and again pulling the second, third, and fourth rods into and back through the site, and removing the cored earth from the site, repeating the process of removing the pulling and holding means, and adding new sections of piping, and then pulling them into the site, as the coring knife and the second, third, and fourth rods are pulled further into the site, until the front cutting and shielding means emerges into the open depression at the front of the site, and the site has thereby been filled with the piping; and (l) disconnecting the pulling and holding means from the second and fourth rods, and removing it from the back of the last piece of piping, pulling the second and fourth rods from the site, removing the front cutting and shielding means, and removing the coring knife.

2. A method of laying piping horizontally underground, in a piping site that is situated between an open depression at the front of the site and an open depression at the back of the site, as described in claim 1, wherein the causing of the first, second, third, and fourth rods to be moved back through the site, as described in paragraph (d) of claim 1, is done by pulling the first rod back through the site.

3. A method of laying piping horizontally underground, in a piping site that is situated between an open depression at the front of the site and an open depression at the back of the site, as described in claim 1, wherein the causing of the first, second, third, and fourth rods to be moved back through the site, as described in paragraph (d) of claim 1, is done by pushing the second, third, and fourth rods into and through the site.

4. A method of laying piping horizontally underground, in a piping site that is situated between an open depression at the front of the site and an open depression at the back of the site, as described in claim 1, wherein earth removal from the site is accomplished by pushing the coring knife back toward the open depression at the back of the site.

5. A method of laying piping horizontally underground, in a piping site that is situated between an open depression at the front of the site and an open depression at the back of the site, as described in claim 1, wherein the causing of the first, second, third, and fourth rods to be moved back through the site, as described in paragraph (d) of claim 1, is done by pulling the first rod back through the site, and wherein earth removal from the site, is accomplished by pushing the coring knife back toward the open depression at the back of the site.

6. A method of laying piping horizontally underground, in a piping site that is situated between an open depression at the front of the site and an open depression at the back of the site, as described in claim 1, wherein the causing of the first, second, third, and fourth rods to be moved back through the site, as described in paragraph (d) of claim 1, is done by pushing the second, third, and fourth rods into and through the site, and wherein earth removal from the site, is accomplished by pushing the coring knife back toward the open depression at the back of.

7. An apparatus for laying piping horizontally underground, in a piping site that is situated between an open depression at the front of the site and an open depression at the back of the site, comprised of:

(a) one pilot rod, that is longer than the length of the piping to be laid, and of sufficient strength to be pushed through the site into which the piping is to be laid, without breaking or bending;

(b) one coring rod, that is longer than the length of the piping to be laid, and of sufficient strength to be pushed through the site into which the piping is to be laid, without breaking or bending;

(c) two steering rods, each of which are longer than the length of the piping to be laid, and of sufficient strength to be pushed through the site into which the piping is to be laid, without breaking or bending;

(d) a rod assembly divider, that is comprised of three cylinders, rigidly connected to each other, such that a first of the cylinders is at one end, a second of the cylinders is in the center, and the third of the cylinders is at the other end, and such that all of the central axes of all three cylinders lie in the same plane;

(e) connecting means, that are able to connect the pilot rod and the coring rod with the central cylinder of the rod assembly divider, and that are able to connect each of the steering rods with one of the first and third cylinders of the rod assembly divider;

(f) a push-pull type earth coring knife, that is suitable to cut a tunnel through the site of a slightly smaller diameter than the diameter of the piping to be laid, and of the same cross-sectional shape as the cross-sectional shape of the piping to be laid, and that can be rigidly connected with the end of the coring rod;

(g) a front cutting shield that is of the same cross sectional shape as the cross sectional shape of the piping to be laid, and of a larger external diameter than the piping to be laid, and has an interior diameter that is larger than the external diameter of the coring knife, a portion of which is smaller than the diameter of the piping to be laid, and which front cutting shield, has, at diametrically-opposed portions of its exterior, cylinders, such that the steering rods can fit through them, which front cutting shield is of sufficient strength to cut through the site, if it is pushed or pulled through the site with sufficient force; and (h) a pulling cap, that is of the same cross sectional shape as the piping to be laid, and has an interior diameter, from its front edge, to near its back edge, that is greater than the external diameter of the piping to be laid, and has an interior diameter near its back edge, that is smaller than the external diameter of the piping to be laid and larger than the external diameter of the coring knife, and has holding means, at diametrically opposed portions of its exterior, to which the steering rods can be fixedly attached.

8. An apparatus for laying piping horizontally underground, in a piping site that is situated between an open depression at the front of the site and an open depression at the back of the site, as described in claim 7, wherein the front cutting shield has a lip that tapers inwardly from its front edge to the internal portion that is of a larger diameter than the external diameter of the coring knife and of a smaller diameter than the external diameter of the piping to be laid.

9. An apparatus for laying piping horizontally underground, in a piping site that is situated between an open depression at the front of the site and an open depression at the back of the site, as described in claim 7, wherein the pilot rod, coring rod, and steering rods, each have threaded ends that taper to a rounded point, and wherein the holding means of the pulling cap are cylinders identical to those located at diametrically opposed ends of the exterior of the front cutting shield, and wherein the connecting means are two threaded couplings of larger external diameters than the diameters of the cylinders at diametrically opposed ends of the pulling cap, which threaded couplings can be threaded onto the ends of the steering rods, and a coupling cylinder that has a larger diameter than the exterior diameter of the central cylinder of the rod assembly divider, and which can be threaded onto the threaded ends of the pilot rod and of the steering rod.

* * * * *